US005660375A

United States Patent [19]

Freeman

[11] Patent Number: 5,660,375

[45] Date of Patent: Aug. 26, 1997

[54] COMPOSITE GUARDRAIL POST

[76] Inventor: John Freeman, P. O. Box 2119, Big Spring, Tex. 79721

[21] Appl. No.: 621,509

[22] Filed: Mar. 25, 1996

Related U.S. Application Data

[63] Continuation of Ser. No. 506,128, Jul. 24, 1995, abandoned, which is a continuation of Ser. No. 146,912, Nov. 1, 1993, abandoned.

[51] Int. Cl.[6] ..... E01F 15/00

[52] U.S. Cl. ..... 256/13.1; 256/19

[58] Field of Search ..... 256/13.1, 19

[56] References Cited

U.S. PATENT DOCUMENTS

| | | | |
|---|---|---|---|
| 1,793,675 | 2/1931 | Camp | 256/13.1 |
| 3,574,104 | 4/1971 | Medler | 156/188 X |
| 3,704,861 | 12/1972 | Glaesener | 256/13.1 |
| 3,784,167 | 1/1974 | Glaesener | 256/13.1 |
| 3,963,218 | 6/1976 | Glaesener | 256/13.1 |
| 4,645,375 | 2/1987 | Carney | 256/13.1 |
| 4,713,645 | 12/1987 | Razavi | 337/246 |
| 5,024,866 | 6/1991 | Goode | 280/819 X |
| 5,152,507 | 10/1992 | Lee | 256/13.1 |
| 5,172,891 | 12/1992 | Chen | 256/13.1 |
| 5,294,151 | 3/1994 | Goode | 280/819 |

*Primary Examiner*—Anthony Knight
*Attorney, Agent, or Firm*—Matthews & Associates, L.L.P.

[57] ABSTRACT

An improved guardrail post which eliminates environmental and health hazards of conventional wood and steel posts resulting from the use of chemical coatings, is disclosed. The improvement is achieved by the use of composite construction which is not subject to the decay, insect damage and corrosion of wood and steel posts which require the application of chemical coatings. Conventional composite posts, tubular in shape and well-known in the prior art, are easily adapted for application and use as guardrail posts. In the preferred embodiment of the present invention, ground, recycled plastic is used as a filler material to prevent damage to the posts which may result from overtightening of guardrail attachment bolts. The plastic filler material may be omitted for an alternate embodiment. The guardrail post may be constructed by pultrusion or related processes.

3 Claims, 1 Drawing Sheet

COMPOSITE GUARDRAIL POST

This application is a continuation of U.S. patent application Ser. No. 08/506,128, filed Jul. 24, 1995, now abandoned, which is a continuation of U.S. patent application Ser. No. 08/146,912, filed Nov. 1, 1993, now abandoned.

BACKGROUND OF THE INVENTION

This invention relates to guardrail posts, and more particularly to guardrail posts which are adapted to meet environmental as well as safety concerns. Due to the widespread use of guardrails along highways, various governmental bodies have developed standardized criteria for guardrails. Factors considered important in the development of those criteria are: the design loadings, design life of a guardrail post exposed to the elements, initial cost, replacement cost, installation method, and vehicle occupant safety upon collision with the guardrail.

The improved guardrail post of the present invention is designed to hold a W-shaped steel guard rail in position with the same strength as a conventional southern white pine post. The present invention will also support other types of guardrails, including those made of other materials, such as composites, and those made in other than the typical "W" shape. The design life of the improved guardrail post will be equal to or greater than that of conventional treated wood posts and galvanized steel posts. Furthermore, the improved guardrail post can be installed by methods currently used for conventional wood and steel posts. The preferred embodiment of the invention can withstand sufficient impact to be driven into the ground in the same manner in which wood guardrail posts are installed.

As important as the design criteria is the fact that new Environmental Protection Agency (EPA) requirements are becoming increasingly larger obstacles to the continued use of wood or steel posts. Because the wood posts are chemically treated to provide better weather and insect resistance, they cannot be disposed of by burning or burying in landfills. The disposal of steel posts is similarly restricted by EPA regulations because of the heavy metal galvanizing required for weather and corrosion resistance. In addition to restrictions on disposal, the use of wood posts is limited by the availability of wood itself. Some states have already encountered shortages of guardrail posts due to limited sources of wood and deforestation concerns.

Although the environmental dangers of the use of wood and steel guardrail posts are not recent developments, public concern over such dangers is relatively new. Notions of using composites in this area in the past had been readily dismissed due to the availability of conventional materials and the indifference to the dangers. With the increasing public awareness of environmental concerns, however, it has become apparent that the present invention is a solution to the dangers posed by prior art guardrail posts.

The prior art includes the following patents: U.S. Pat. No. 3,709,112 to Ebinger; U.S. Pat. No. 3,820,906 to Katt; U.S. Pat. No. 4,092,081 to Schmanski; and U.S. Pat. No. 4,939,037 to Zion and Freeman.

OBJECTS OF THE INVENTION

An important object of the present invention is to provide an improved guardrail post which eliminates environmental and health hazards of conventional guardrail posts.

Another object of the invention is to provide an improved guardrail post which is made of composite materials.

Another object of the invention is to provide an improved guardrail post which utilizes recycled plastic in its construction.

Another object of the invention to provide an improved guardrail post which can be recycled when it is damaged by a vehicle collision.

SUMMARY OF THE INVENTION

The foregoing and other objects and advantages of the invention are provided in an improved guardrail post made of composites. The improvement is realized through the reduced environmental and health danger and through increased availability, disposability and recyclability over prior art posts.

The improved guardrail post employs a conventional composite post suitable for installation and use as a guardrail post. The design of the post is such that it has the strength and engineering design characteristics of a standard white pine post, though these characteristics may be varied. In the preferred embodiment, the post is filled with recycled plastic or other filler material which resists compression and deformation of the post which results from overtightening of guardrail attachment bolts. In other embodiments, the post need not be filled and attachment means other than bolts may be used.

The use of composites eliminates environmental and health hazards which result from the use of chemical coatings on conventional wood and steel posts. The composite construction is not subject to decay, insect damage or corrosion, as are wood and steel which require the application of chemical coatings. Conventional composite posts, cylindrical in shape and well-known in the prior art, are also readily available and easily adapted for use as guardrail posts. Finally, in addition to using recycled material as filler, the composite posts can be recycled when damaged and used as filler for new composite guardrail posts or other applications.

In the preferred embodiment of the present invention, ground, recycled plastic is used as a filler material to prevent damage to the posts which may result from overtightening of guardrail attachment bolts. The plastic filler material may be omitted for an alternate embodiment. The guardrail post may be constructed by pultrusion or related processes.

DESCRIPTION OF THE PREFERRED EMBODIMENT

Figure 2:
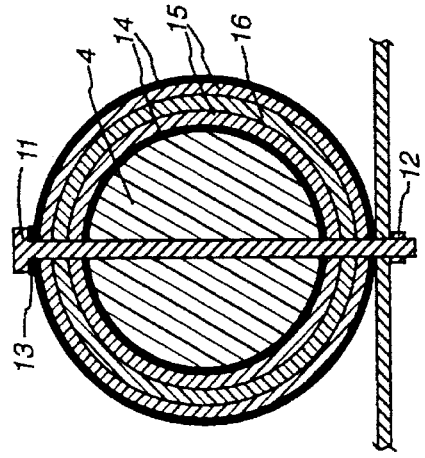
FIG. 2 is a cross-sectional view through the upper portion of the post and attached guardrail.

Referring to FIGS. 2A and 2B, one embodiment of the improved composite guardrail post, 10, of this invention is shown. The composite post, 1, used in the present invention is constructed by pultrusion, and cut to the required length. The pipe's outermost layer is a polyester veil, 14, followed by a layer of matt fiberglass, 15, a layer of straight longitudinal fiberglass, 16, another layer of matt fiberglass, 15, and, finally, another polyester veil, 14, on the inside diameter. The guardrail, 3, is attached to the improved guardrail post by a bolt, 12, which extends through the guardrail and post and is secured by a washer, 13, and nut, 11. The post is filled with filler material, 2, which in the preferred embodiment is recycled plastic.

Figure 1:
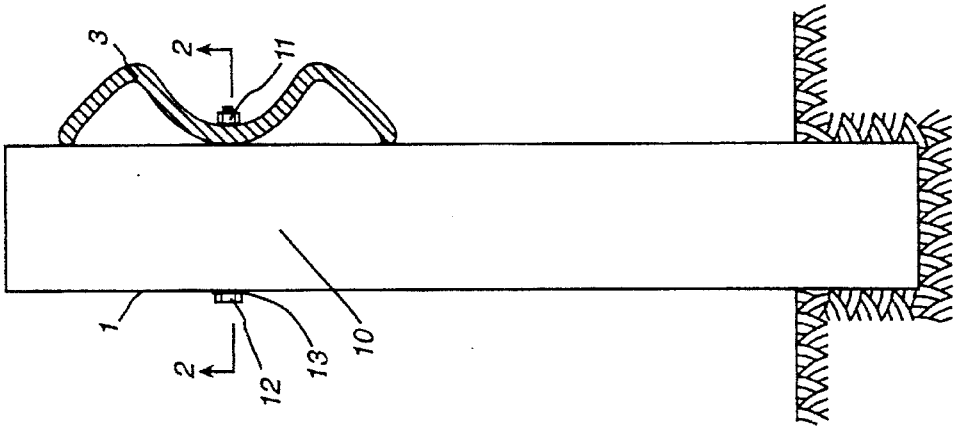
FIG. 1 is a side elevation of the improved guardrail post of this invention, installed in the ground with a guardrail attached.

In FIG. 1, The post, 1, is illustrated in a side view with a guardrail, 3, attached by the conventional nut and bolt mounting system depicted in FIGS. 2A and 2B.

The preferred embodiment of the present invention uses a six inch diameter composite post with one-quarter inch wall thickness. The length of the post is determined by the particular application. The post is filled with recycled plastic, and bolt holes are drilled in the post in accordance with requirements of the guardrail to be attached.

Figure 3:
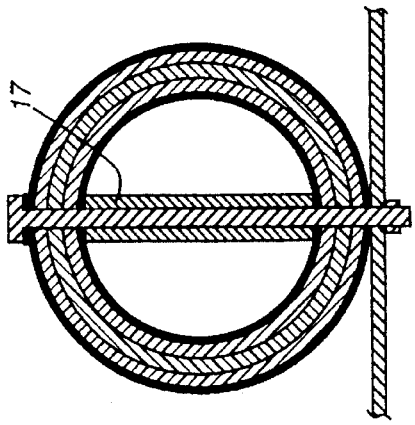
FIGS. 3–5 are cross-sectional views through the upper portion of the post and attached guardrail for alternate embodiments of the invention.
Figure 5:
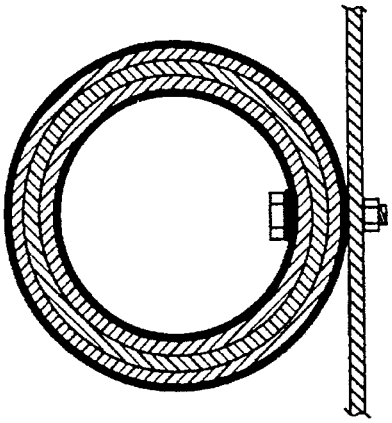
Figure 4:
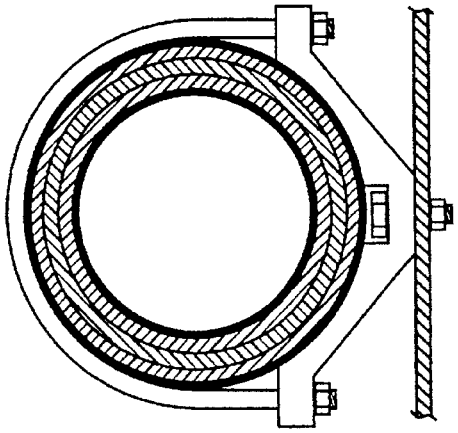

In alternative embodiments, the plastic filler, 2, may be omitted or replaced with other means to prevent deformation of the post. Such means include the internal brace, 17, which is depicted in FIG. 3 as a spacer through which the bolt is inserted. Alternative embodiments may also substitute alternative means for attaching the guardrail to the improved guardrail post. Examples of such means are shown in FIGS. 4 and 5 and may eliminate the need for the means to prevent deformation of the post. Alternative embodiments may further include posts which more closely resemble the steel posts than the wood posts of the prior art. The posts of these embodiments may be in the form of I-beams or similar structures and would not utilize the filler material.

It is to be understood that the form of the invention herein shown and described is to be taken as a preferred example, and that numerous variations will be obvious to those skilled in the art in the light of the teachings of this specification, without departing from the scope of the hereinafter claimed subject matter.

What is claimed is:

1. A composite guardrail post comprising:

a rigid composite post having a first end disposed in the ground and a second end adapted for rigidly connecting a guardrail thereto, said post having a first layer of a polyester veil and a second layer of a matt fiberglass; and a third layer of a straight longitudinal fiberglass.

2. The composite guardrail post of claim 1, further including:

a fourth layer of matt fiberglass.

3. The composite guardrail post of claim 2, further including:

a fifth layer of a polyester veil.

* * * * *